US011250817B2

(12) United States Patent
Minaki et al.

(10) Patent No.: US 11,250,817 B2
(45) Date of Patent: Feb. 15, 2022

(54) DISPLAY DRIVER

(71) Applicant: Synaptics Incorporated, San Jose, CA (US)

(72) Inventors: Tomoo Minaki, Tokyo (JP); Hirobumi Furihata, Tokyo (JP); Takashi Nose, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 7 days.

(21) Appl. No.: 16/763,937

(22) PCT Filed: Nov. 15, 2018

(86) PCT No.: PCT/US2018/061273
§ 371 (c)(1),
(2) Date: May 13, 2020

(87) PCT Pub. No.: WO2019/099663
PCT Pub. Date: May 23, 2019

(65) Prior Publication Data

US 2020/0279542 A1 Sep. 3, 2020

Related U.S. Application Data

(60) Provisional application No. 62/587,362, filed on Nov. 16, 2017.

(51) Int. Cl.
*G09G 5/37* (2006.01)
*G09G 3/20* (2006.01)

(52) U.S. Cl.
CPC ..... *G09G 5/37* (2013.01); *G09G 3/2096* (2013.01); *G09G 2340/0464* (2013.01); *G09G 2340/14* (2013.01)

(58) Field of Classification Search
CPC ..... G09G 5/37
See application file for complete search history.

(56) References Cited

U.S. PATENT DOCUMENTS

| | | | | |
|---|---|---|---|---|
| 2009/0058880 | A1 | 3/2009 | Tremblay | |
| 2009/0237406 | A1* | 9/2009 | Chen | G06T 11/203 345/441 |
| 2013/0264957 | A1 | 10/2013 | Takatori | |
| 2016/0178940 | A1 | 6/2016 | Yuan et al. | |
| 2016/0189601 | A1 | 6/2016 | Jung et al. | |
| 2016/0240141 | A1 | 8/2016 | Lee et al. | |

OTHER PUBLICATIONS

International Search Report issued in corresponding application No. PCT/US2018/061273 dated Mar. 12, 2019 (3 pages).
Written Opinion of the International Searching Authority issued in corresponding application No. PCT/US2018/061273 dated Mar. 12, 2019 (5 pages).

* cited by examiner

*Primary Examiner* — Gustavo Polo
(74) *Attorney, Agent, or Firm* — Ferguson Braswell Fraser Kubasta PC

(57) ABSTRACT

A display driver is disclosed. The display driver includes: a memory configured to store control points defining a curve associated with a display panel; and shape calculation circuitry configured to: determine, based on the control points, a first intersection point of the curve and a width of a first line associated with the display panel; and modify image data of an image based on the first intersection point.

22 Claims, 14 Drawing Sheets

DISPLAY DRIVER

FIELD

The disclosed technology generally relates to a display driver for controlling a display panel.

BACKGROUND

Display devices including display panels such as a light emitting diode (LED) display, organic light emitting diode (OLED) display, cathode ray tube (CRT) display, liquid crystal display (LCD), plasma display, and electroluminescence (EL) display are widely used in a variety of electronic systems, such as cellular phones, smartphones, notebook or desktop computers, netbook computers, tablet PCs, electronic book readers, personal digital assistants (PDAs), and vehicles including cars equipped with the display panels. Display states of a display panel may be controlled by a display driver. The display driver may be integrated with a touch driver to constitute, for example, a touch and display driver integrated (TDDI) circuitry/chip to be used in a touch display that has both display and touch detection functionality.

SUMMARY

In general, in one aspect, one or more embodiments are directed towards a display driver. The display driver comprises: a memory configured to store a plurality of control points defining a curve associated with a display panel; and shape calculation circuitry configured to: determine, based on the plurality of control points, a first intersection point of the curve and a width of a first line associated with the display panel; and modify image data of an image based on the first intersection point.

In general, in one aspect, one or more embodiments are directed towards a method. The method comprises: storing a plurality of control points defining a curve associated with a display panel; determining, based on the plurality of control points, a first intersection point of the curve and a width of a line associated with the display panel; and modifying image data based on the first intersection point.

In general, in one aspect, one or more embodiments are directed towards a system. The system comprises: a processing device comprising image data; a display panel; and a display driver comprising: a memory configured to store a plurality of control points defining a curve associated with the display panel; and shape calculation circuitry configured to: determine, based on the plurality of control points, a first intersection point of the curve and a width of a line associated with the display panel; and modify the image data based on the first intersection point.

Other aspects of the embodiments will be apparent from the following description and the appended claims.

DETAILED DESCRIPTION

In the following detailed description of embodiments, numerous specific details are set forth in order to provide a more thorough understanding of the disclosed technology. However, it will be apparent to one of ordinary skill in the art that the disclosed technology may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may succeed (or precede) the second element in an ordering of elements.

Figure 1:
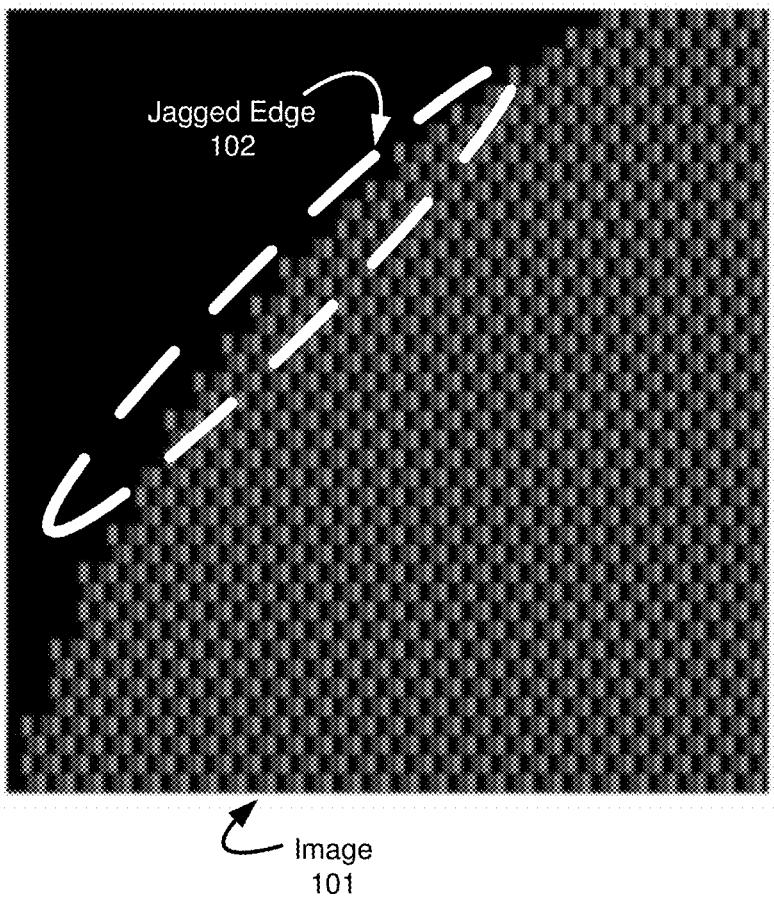
FIG. 1 shows an example in accordance with one or more embodiments.

Electronic devices (e.g., smartphones, tablet personal computers (PCs), etc.) may be equipped with display panels having shapes other than mere rectangles. For example, an electronic device may have a display panel with rounded corners. Additionally or alternatively, an electronic device may have a display panel with a concave portion at its top and/or bottom. A displayed image might not appear correctly if the image data has not been processed to fit the unique shape of the display panel. For example, FIG. 1 shows a displayed image (101) with a jagged edge (102) at a rounded corner. The jagged edge (102) may be due to improper processing (or no processing) of the image data to fit the unique shape of the display panel. As another example, the array of sub-pixels (e.g., R, G, B) might be irregular near the edges of rounded corners due to the image data not being processed to fit the unique shape of the display panel. This may result in color shift that is visible to the user of the electronic device.

One or more embodiments provide a display driver for a display panel with a unique shape, a display device equipped with a display driver and a display panel, and a method that facilitates improved operation of the display panel. One or more embodiments provide a system and method for displaying an image on a display panel having a unique shape describe by one or more curves. The displayed image is less likely to have jagged edges, is less likely to suffer from color shift, and may be displayed without using addition memory (e.g., RAM) to store all of the image data corresponding to the unique shape.

Figure 2:
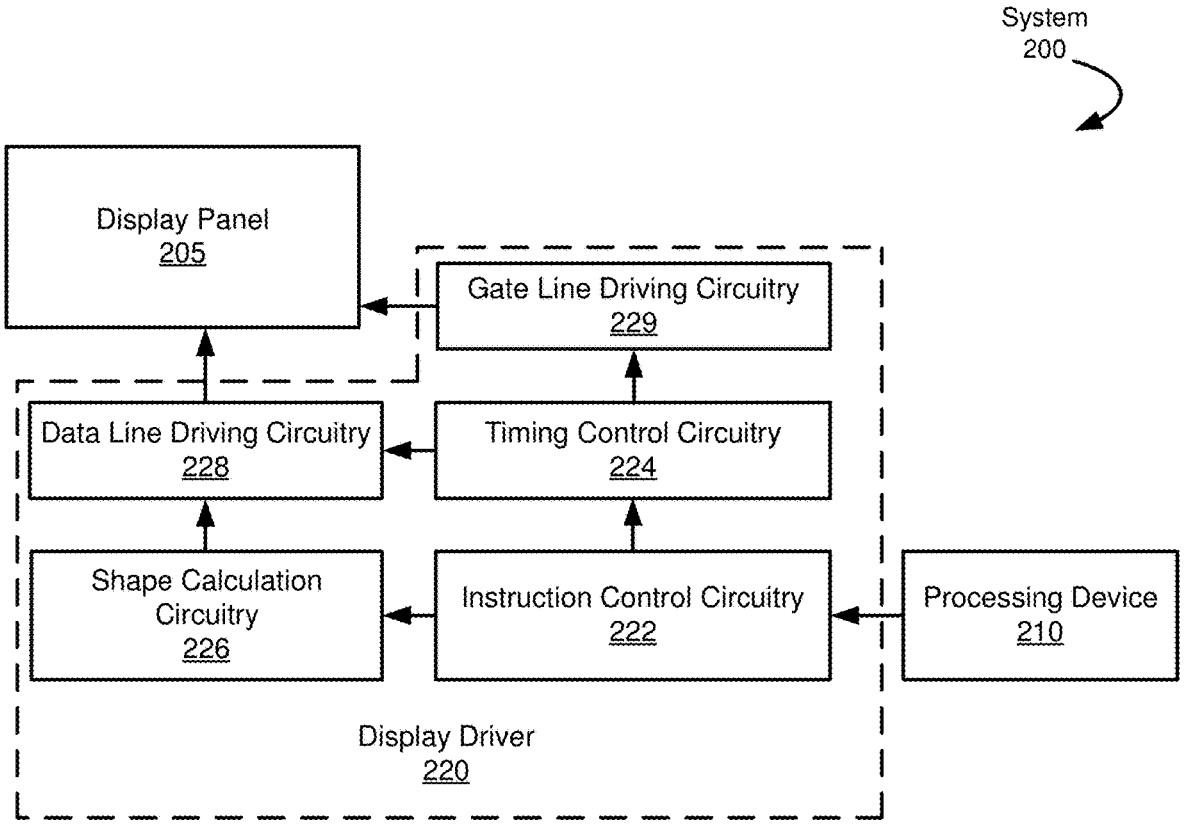
FIG. 2 shows a block diagram of a system in accordance with one or more embodiments.

FIG. 2 is a block diagram of a system (200) in accordance with one or more embodiments. The system (200) includes a display panel (205) and a display driver (220) electrically connected to the display panel (205). The display driver (220) drives the display panel (205) in response to image data and/or control instruction received from a processing device (210). The processing device (210) may include a processor such as an application processor and/or a central processing unit (CPU).

In one or more embodiments, the display panel may have any shape. For example, the display panel (205) may have rounded corners. The display panel (205) may be a liquid crystal display (LCD). Additionally or alternatively, the display panel (205) may be an organic light emitting diode (OLED) display. The display panel (205) may include pixels formed of switching elements, such as thin film transistors (TFTs) and n-type or p-type metal-oxide-semiconductor field-effect transistors (MOSFETs), arranged in a grid pattern. The switching elements (i.e., pixels) may be connected to gate lines and data lines so as to individually switch on/off the pixels in response to driving signals from the display driver (220). A row or column of pixels may correspond to a line of the display panel (205). Moreover, each line may have a width corresponding to the height or width of a pixel.

In one or more embodiments, the display driver (220) includes instruction control circuitry (222), timing control circuitry (224), gate line driving circuitry (229), data line driving circuitry (228) including digital-analog converter (DAC) (not shown), and shape calculation circuitry (226). Each of these components (222, 224, 226, 228, 229) may be implemented in any combination of hardware and software. In one embodiment, the display driver (220) is a display driver integrated circuit (IC). In one or more embodiments, the instruction control circuitry (222) causes the timing control circuitry (224) to control the timing of driving of the gate lines of the display panel (205) by the gate line driving circuitry (229), and to control the timing of driving of the data lines of the display panel (205) by the data line driving circuitry (228).

In one or more embodiments, the shape calculation circuitry (226) processes image data for display on the display panel (205). For example, the display panel (205) may include many lines of pixels, and the shape calculation circuitry (226) may process image data for the display panel (205) on a line-by-line basis.

In one or more embodiments, the display panel (205) have a unique shape. All or some of the shapes (e.g., one or more rounded corners) may be described by one or more curves. The shape calculation circuitry (226) may calculate intersection points associated with the curve and the lines. These intersection points may be used to modify the image data to fit the display panel (205) such that the image is displayed without jagged edges or color shifts. In one or more embodiments, these modifications may include setting transparency values of the image and/or setting one or more regions of the image to black (discussed below).

Figure 3A:
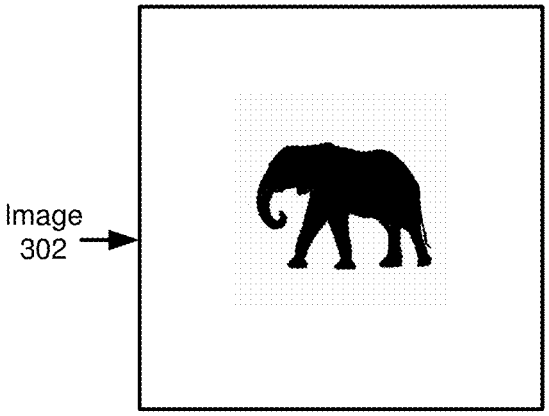
FIG. 3A-3D show examples in accordance with one or more embodiments.

FIG. 3A shows an example image (302) in accordance with one or more embodiments. As shown in FIG. 3A, the image (302) is rectangular in shape.

Figure 3B:
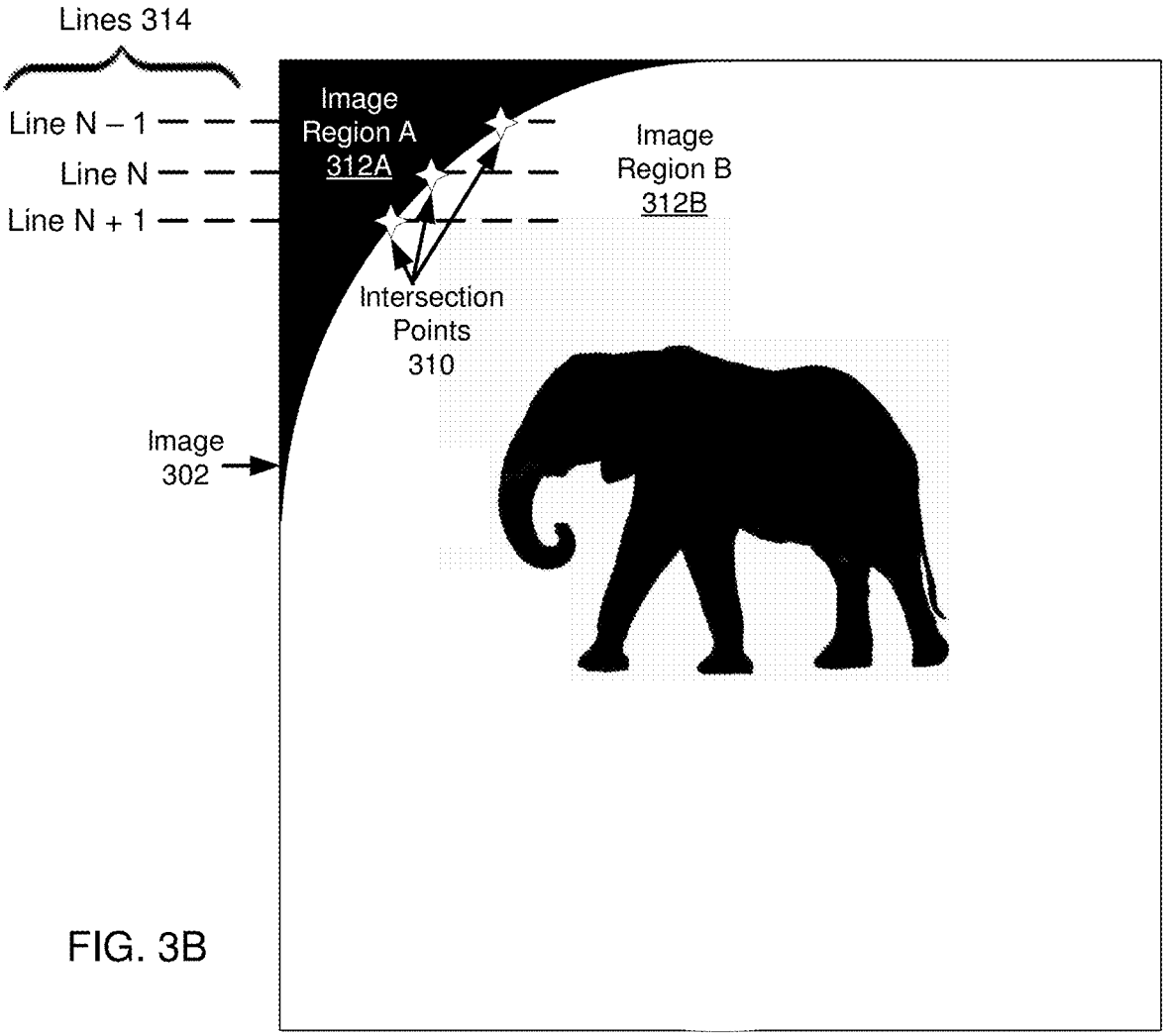

FIG. 3B shows the image (302) after processing by the shape calculation circuitry (226) (e.g., after the image data is modified). In this example, assume the top left corner of the display panel (205) is rounded and described by curve (not labeled). As shown, the image region outside the rounded corner (i.e., image region A (312A)) is set to black, while the image region inside the rounded corner (i.e., image region B (312B)) remains in the original color(s). Further, in FIG. 3B, some lines (314) of the display panel (205) and some intersections points (310) (with the curve) are superimposed on the image (302). For each of the lines (314), the intersection points (310) are the boundary between the image region that should be all black (i.e., image region A (312A)) and the image region that should be displayed in the original color(s) (i.e., image region B (312B)). In one or more embodiments, the intersection points (310) are switching points between drawing the lines (314) in all black and drawing the lines (314) according to the original color(s).

In one or more embodiments, by setting the regions outside the rounded corner to black, the rounded corners will appear smoother when the image is displayed on the display panel.

Figure 3C:
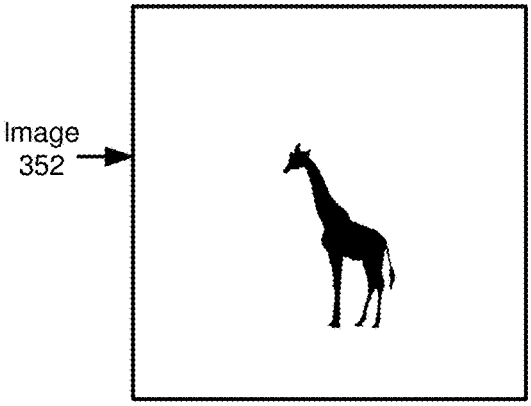

FIG. 3C shows an example image (352) in accordance with one or more embodiments. As shown in FIG. 3C, the image (352) is rectangular in shape.

Figure 3D:
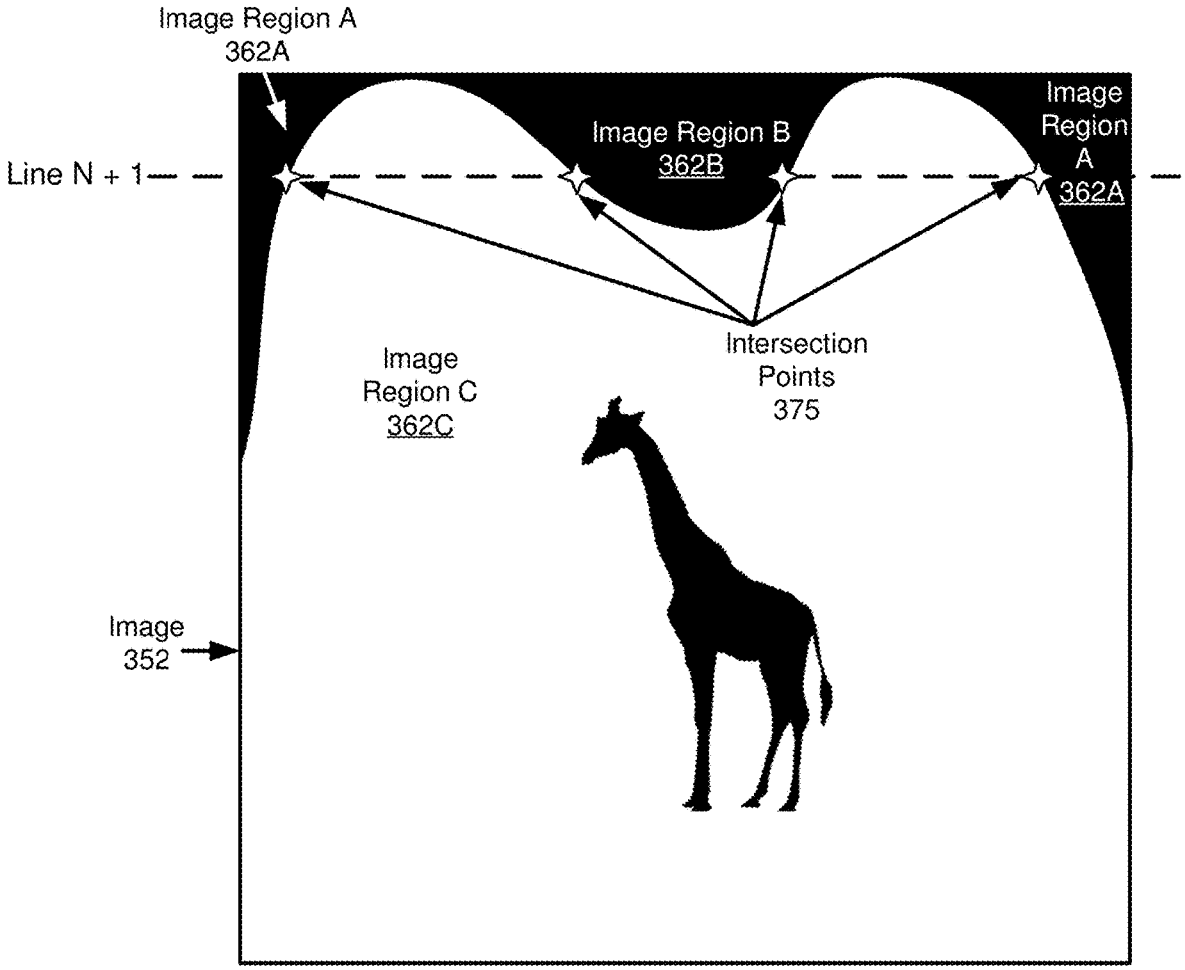

FIG. 3D shows the image (352) after processing by the shape calculation circuitry (226) (e.g., after the image data is modified). As shown in this example, assume both the top left corner and the top right corner of the display panel (205) are rounded. Further, assume the display panel has a concave portion at its top. As shown, the image regions outside the rounded corners (i.e., image region A (362A)) are set to black, the image region outside the concave portion is set to black (i.e., image region B (362)), while the image region inside the rounded corner and inside the concave portion remains in the original color(s) ((i.e., image region C (362C)). The line N+1 and its intersection points (375) with the curve (not labeled) are superimposed on the image (352). The intersection points (375) are the boundaries between the image regions (362A, 362B) that should be all black and image region C (362C) that should be displayed in the original color(s). In one or more embodiments, the intersection points (375) are switching points between drawing the line N+1 in all black and drawing the line N+1 according to the original color(s).

Referring back to FIG. 2, although not shown, the display driver (220) may be integrated with a touch driver to constitute, for example, a touch and display driver integrated (TDDI) circuitry/chips. The display panel (205) may have both display and touch detection functionality. The TDDI circuitry/chip may thus have the combined functions of the display driver and the touch driver.

Figure 4:
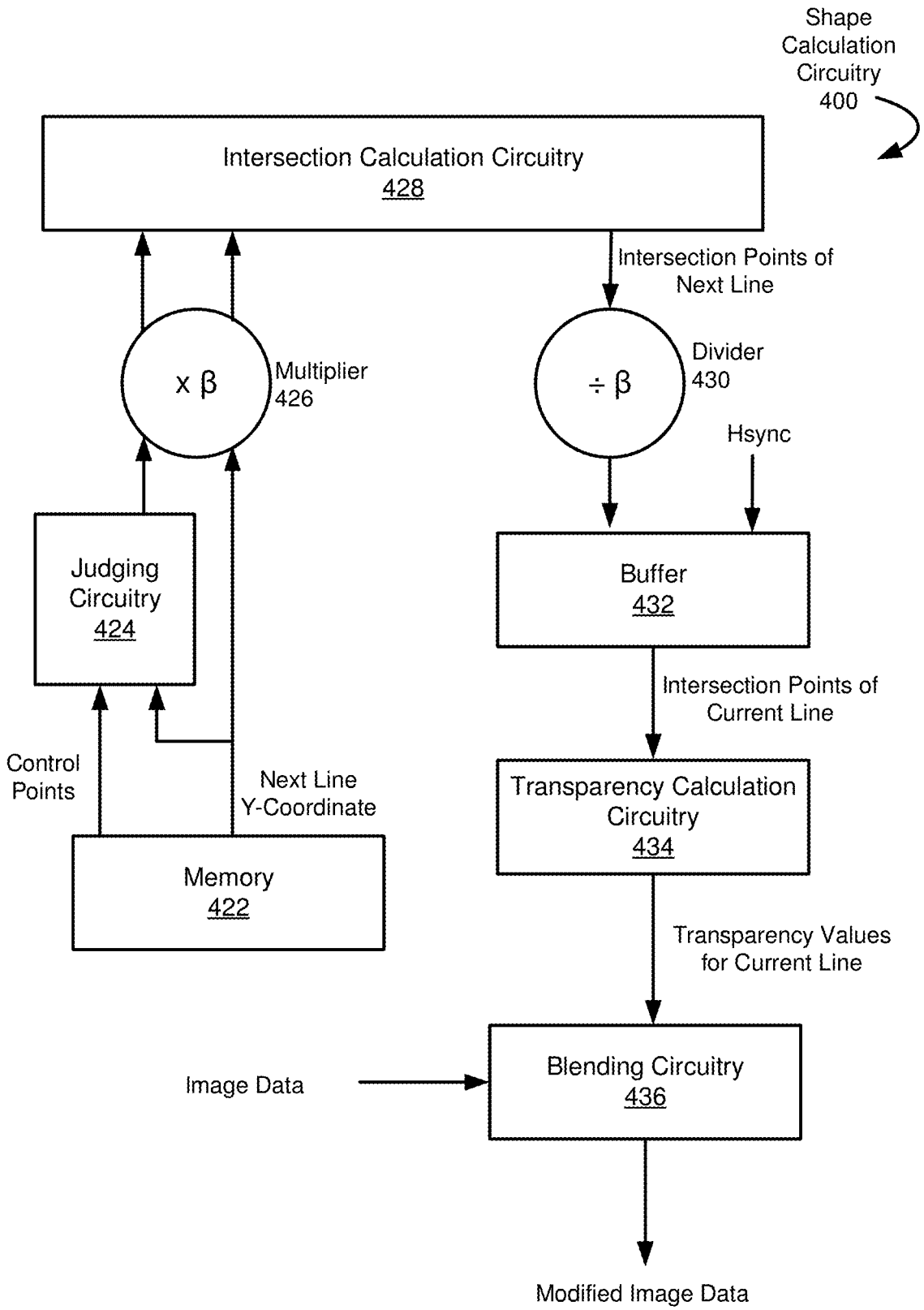
FIG. 4 shows a block diagram of shape calculation circuitry in accordance with one or more embodiments.

FIG. 4 is a block diagram of shape calculation circuitry (400) in accordance with one or more embodiments. The shape calculation circuitry (400) may correspond to the shape calculation circuitry (226), discussed above in reference to FIG. 2. As shown in FIG. 4, the shape calculation circuitry (400) has multiple components including a memory (422), judging circuitry (424), a multiplier (426), intersection calculation circuitry (428), a divider (430), a buffer (432), transparency calculation circuitry (434), and blending circuitry (436). Each of these components (422, 424, 426, 428, 430, 432, 434, 436) may be implemented in any combination of hardware and software. In one or more embodiments, the multiplier (426) and the divider (430) are optional.

In one or more embodiments, the memory (422) stores and outputs control points defining the one or more curves associated with the display panel (205). Each curve may be described by multiple (e.g., 3, 8, etc.) control points. In one or more embodiments, the display driver (220) processes image data on a line-by-line basis. In one or more embodiments, the memory (422) also stores and outputs the next line (e.g., the y-coordinate of the next line) to be processed based on signals (not shown) from the instruction control circuitry (222). The memory (422) may be implemented as one or more registers.

Figure 5A:
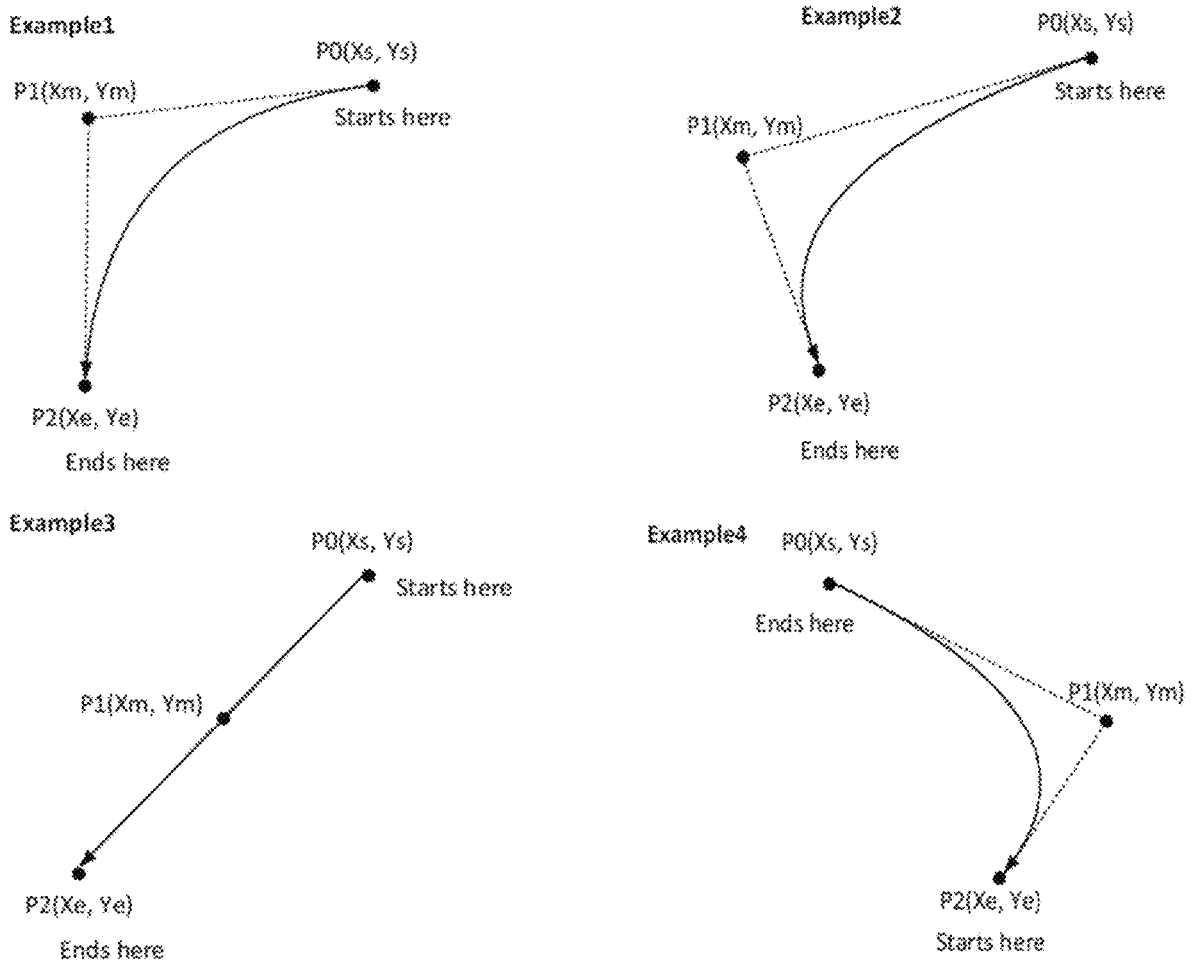
FIGS. 5A-5E show examples in accordance with one or more embodiments.

In one or more embodiments, each curve corresponds to a Bezier curve such as a quadratic Bezier curve. FIG. 5A shows four examples of quadratic Bezier curves. Each curve is described by three control points: a start point P0($X_S$, $Y_S$); an end point P2($X_E$, $Y_E$); and an intermediate or middle point P1($X_M$, $Y_M$). Each curve starts from its start point P0 and ends at its end point P2, but does not pass through its intermediate point P1. P0, P1, and P2 are examples of control points that may be stored and output by the memory (422).

Referring back to FIG. 4, in one or more embodiments, the judging circuitry (424) determines which of the control points received from the memory (422) are within a target range to be processed. For example, if the corner drawing process starts at point ($X_1$, $Y_1$) and ends at point ($X_2$, $Y_2$), then control points with y-coordinates between $Y_1$ and $Y_2$ fall within the target range. In one or more embodiments, the judging circuitry (424) outputs control points within the range when the y-coordinate of the next-line is also within the range and/or matches the y-coordinate of the starting point or ending point.

In one or more embodiments, the intersection calculation circuitry (428) calculates the intersection point(s) of the next-line with one or more curves defined by the control points from the judging circuitry (424).

FIG. 5B-5E show an example method for calculating the intersection points in accordance with one or more embodiments. Assume there are three control points corresponding to the starting point ($X_{s0}$, $Y_{s0}$) of the quadratic Bezier curve, the ending point ($X_{e0}$, $Y_{e0}$) of the quadratic Bezier curve, and the intermediate or middle point ($X_{m0}$, $Y_{m0}$).

Figure 5B:
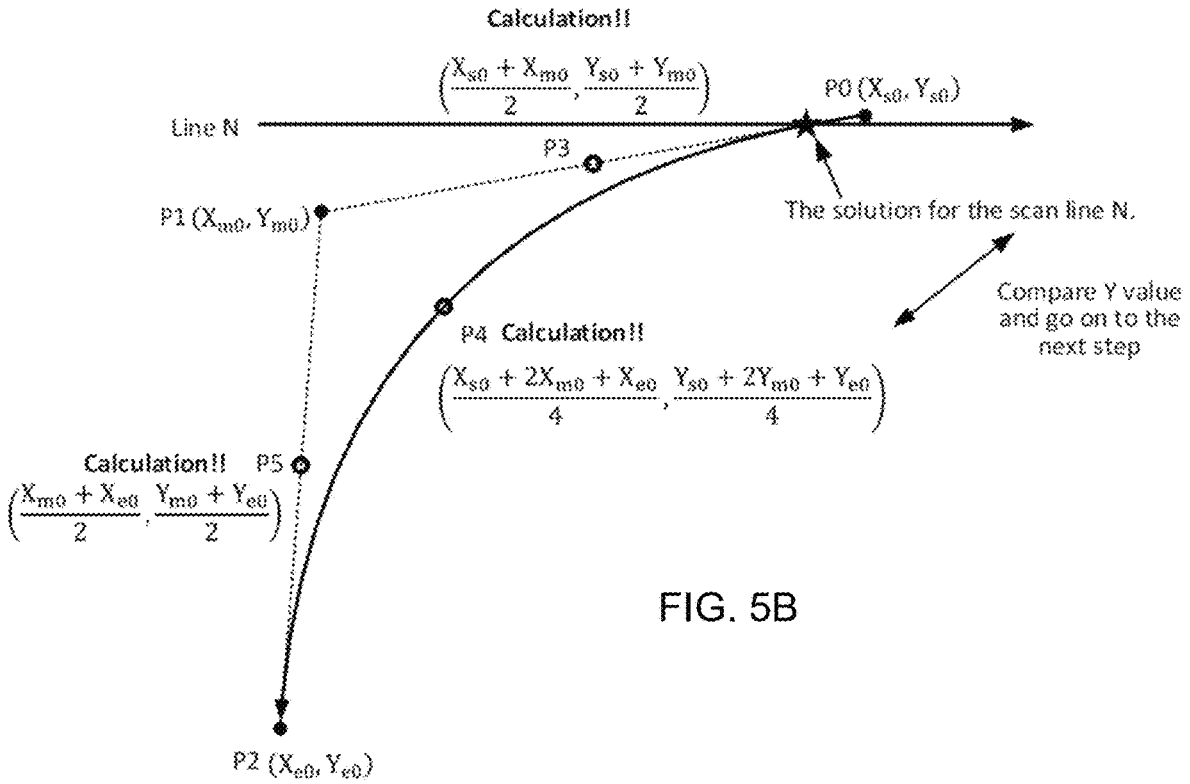

FIG. 5B shows the first step. In the first step, three new points P3, P4, and P5 are calculated:

$$P3\left(\frac{X_{s0}+X_{m0}}{2}, \frac{Y_{s0}+Y_{m0}}{2}\right)$$

$$P4\left(\frac{X_{s0}+2X_{m0}+X_{e0}}{4}, \frac{Y_{s0}+2Y_{m0}+Y_{e0}}{4}\right)$$

$$P5\left(\frac{X_{m0}+X_{e0}}{2}, \frac{Y_{m0}+Y_{e0}}{2}\right)$$

Those skilled in the art, having the benefit of this detailed description, will appreciate calculating the new points involves calculating midpoints. Moreover, as shown in FIG. 5B, P4 is located on the quadratic Bezier curve itself.

In the second step, the y-value of P4 is compared with the y-coordinate of the next line (as provided by the memory (422)).

Figure 5C:
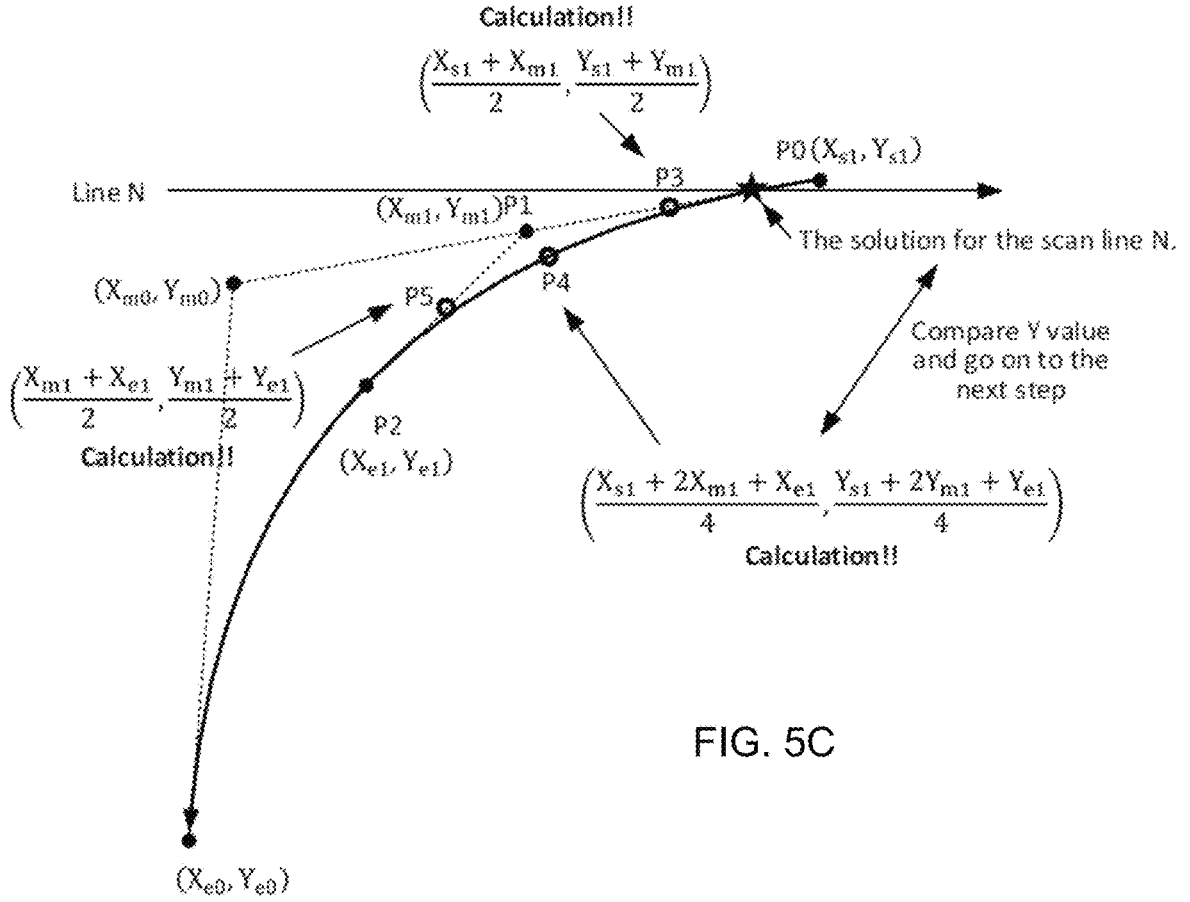
Figure 5D:
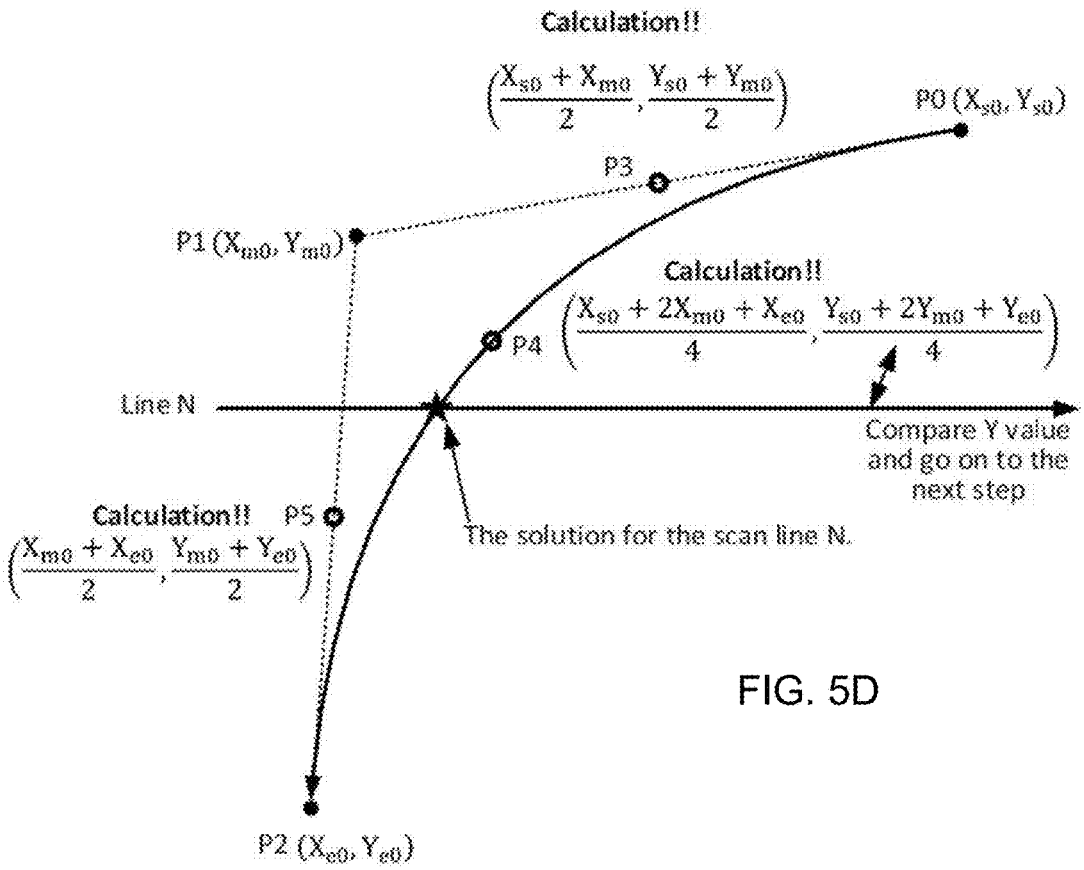
Figure 5E:
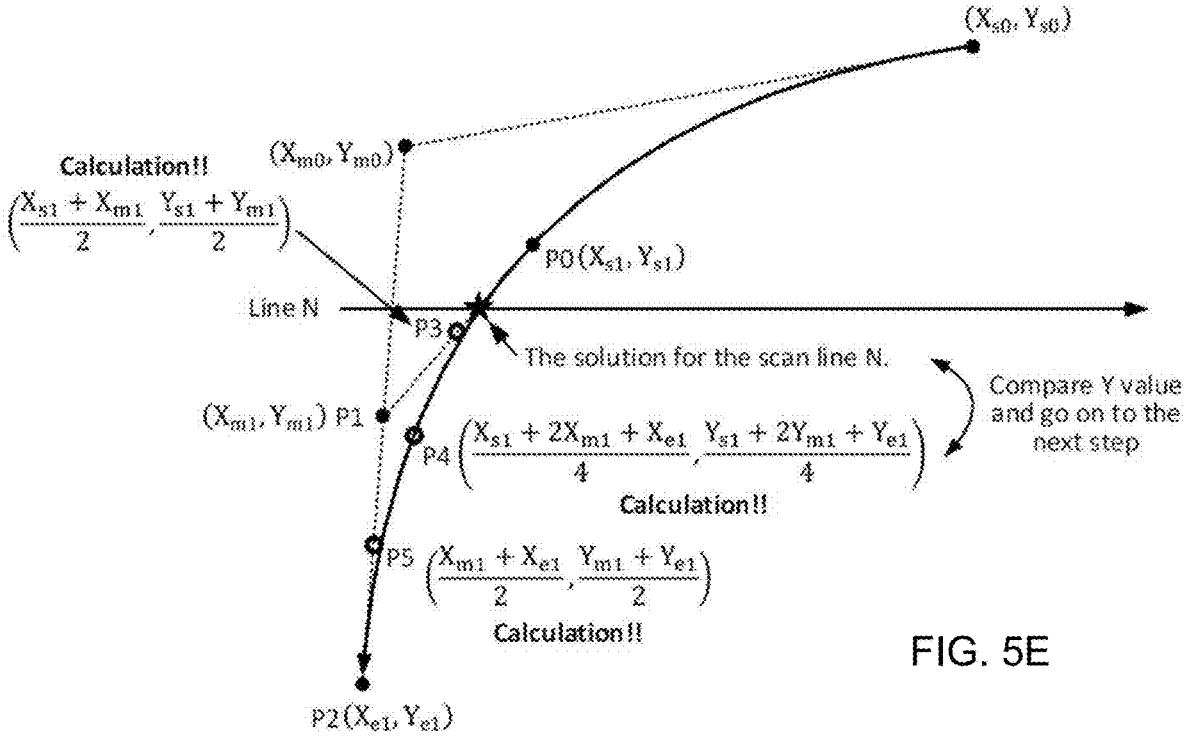

In the third step, if the y-value of P4 is smaller than the y-coordinate of the next line (as shown in FIG. 5B), then P4 is relabeled as P2, and P3 is relabeled as P1. This is shown in FIG. 5C. Otherwise, if the y-value of P4 is larger than the y-coordinate of the next line (shown in FIG. 5D), P4 is relabeled as P0, and P5 is relabeled as P1 (shown in FIG. 5E).

These three steps are repeated until at least one of P3, P4, and P5 has a y-coordinate that equals (or approximately equals) the y-coordinate of the next line. This point (i.e., P3, P4, or P5) is the intersection point associated with the next line and the curve. In one or more embodiments, there may be multiple intersection points for a single line. In one or more embodiments, these intersection points are the switching points between drawing the line as all black and drawing the line accordingly to the original color(s) of the image.

Figure 6:
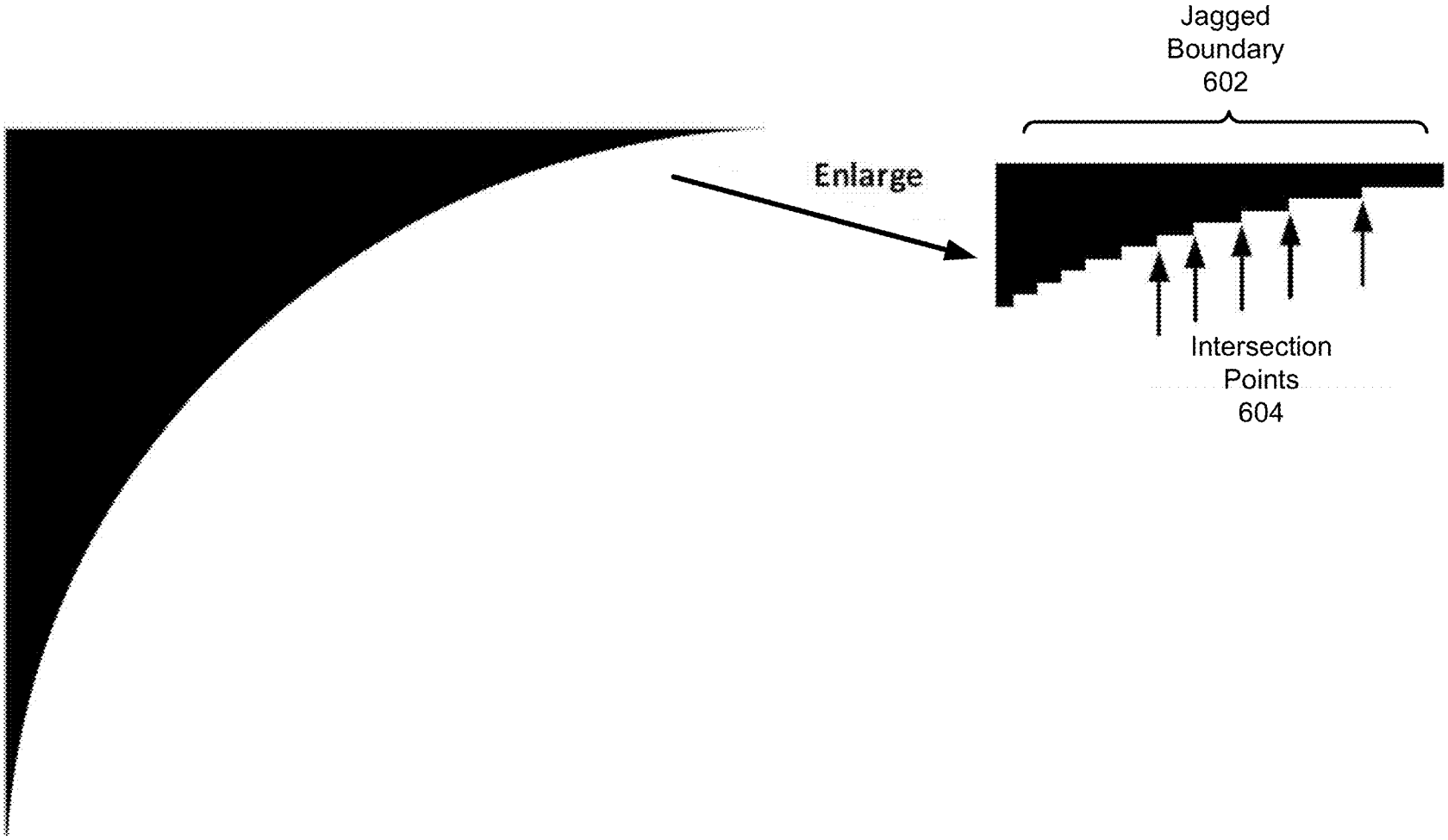
FIG. 6 shows an example jagged edge in accordance with one or more embodiments.

In one or more embodiments, each line corresponds to a row of pixels. The height of these pixels in the row defines the width of the line. In such embodiments, when the image is drawn based on the intersection points, and there is only intersection point for the width of the line, the boundary between the image region that is all black and the image region that is in the original color(s) may be jagged. FIG. 6 shows an example of a jagged boundary (602) resulting from the intersection points (604) when there is one intersection point within the width of a line.

In one or more embodiments, in order to draw the boundary with smooth gradation, the image around the boundary should be processed to be blurry. This type of processing may be referred to as anti-aliasing. In one or more embodiments, to perform anti-aliasing, the width of the line is divided into K (e.g., K=4) segments. The line N is considered to pass through one segment, the line N+0.25 is considered to pass through the next segment, the line N+0.5 is considered to pass through the next segment, and the line N+0.75 is considered to pass through the last segment. In such embodiments, the additional intersection points associated with the curve and lines N+0.25, N+0.5, and N+0.75 are calculated by the intersection calculation circuitry (428).

In one or more embodiments, the transparency calculation circuitry (434) calculates transparency values for the pixels near/on the boundary. The transparency calculation circuitry (434) may obtain the intersection points associated with the curve and the width of the line (e.g., intersection points with lines N, N+0.25, N+0.5, and N+0.75). The transparency value of a pixel may depend on the presence and location of an intersection point within the pixel (i.e., the pixel overlaps an intersection point). The transparency value of a pixel may also depend on the absence of an intersection point within the pixel.

In one or more embodiments, the transparency calculation circuitry (434) effectively partitions a pixel into multiple cells. If a line width is divided into K segments (e.g., K=4), the pixel may be partitioned into K×K cells. If a pixel of the line does not intersect with the curve, the pixel will be assigned either zero transparency or full transparency.

In one or more embodiments, the transparency calculation circuitry (434) scans each row of cells in a predetermined direction (e.g., from left to right, from right to left, etc.). Upon finding a cell with an intersection point ("hit cell"), all cells in the row before the hit cell are designated to be black cells. All cells in the row after the hit cell and the hit cell itself are designated to be white cells. This process is repeated for each row of cells in the line width. In one or more embodiments, the transparency value for a pixel is based on a count of the black cells in the pixel. In one or more embodiments, the transparency value for a pixel is based on the number of white cells in the pixel. In one or more embodiments, the transparency is based on a ratio associated with the total number of cells (i.e., the cardinality of cells) in the pixel (i.e., $K^2$).

Figure 7:
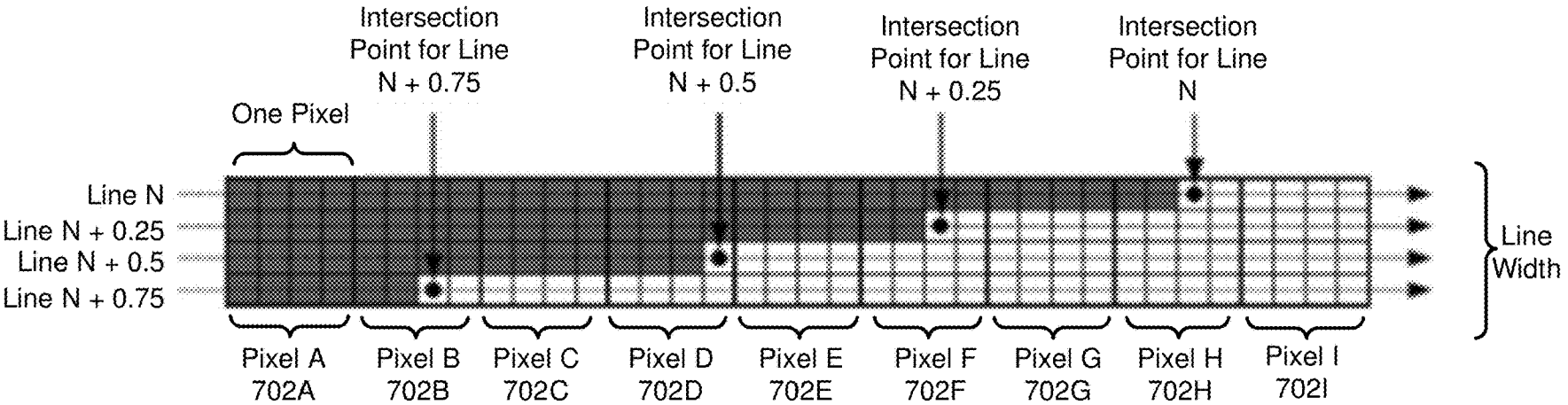
FIG. 7 shows an example associated with transparency calculation circuitry in accordance with one or more embodiments.

FIG. 7 shows an example in accordance with one or more embodiments. As shown, there are 9 pixels (i.e., pixel A (702A), pixel B (702B), pixel C (702C), pixel D (702D), pixel E (702E), pixel F (702F), pixel G (702G), pixel H (702HJ), pixel I (702I)) associated with line N. Further, as also shown in FIG. 7, line N has been divided into 4 segments and intersection points have been calculated for line N, line N+0.25, line N+0.5, and line N+0.75. Further still, each pixel (702A, 702B, 702C, 702D, 702E, 702F, 702G, 702H, 702I) has been partitioned into $16=4^2$ cells.

In this example, the cell in pixel B (702B) with the intersection point for line N+0.75 is a hit cell, the cell in pixel D (702D) with the intersection point for line N+0.5 is a hit cell, the cell in pixel F (702F) with the intersection point for line N+0.25 is a hit cell, and the cell in pixel H (702H) with the intersection point for line N is a hit cell. Moreover, in this example, the predetermined direction is from left to right. As shown in FIG. 7, all cells before (i.e., to the left) of the hit cells are designated black cells. All cells after (i.e., to the right) of the hit cells and the hit cells themselves are designated white cells. In this example, the transparency value for a pixel is the count of white cells in the pixel to the total number of cells in the pixel (i.e., 16).

Still referring to FIG. 7, the count of white cells for pixel B (702B) is 2 and the ratio for pixel B (702B) is 2/16. Accordingly, the transparency value for pixel B (702B) should be 2/16 of full transparency. The count of white cells for pixel C (702C) is 4 and the ratio for pixel C (702C) is 4/16. Accordingly, the transparency value for pixel C (702C) should be 4/16 of full transparency. The count of white cells for pixel D (702D) is 5 and the ratio for pixel D (702D) is 5/16. Accordingly, the transparency value for pixel D (702D) should be 5/16 of full transparency. The count of white cells for pixel E (702E) is 8 and the ratio for pixel E (702E) is 8/16. Accordingly, the transparency value for pixel E (702E) should be 8/16 of full transparency. The count of white cells for pixel F (702F) is 10 and the ratio for pixel F (702F) is 10/16. Accordingly, the transparency value for pixel F (702F) should be 10/16 of full transparency. The count of white cells for pixel G (702G) is 12 and the ratio for pixel G (702G) is 12/16. Accordingly, the transparency value for pixel G (702G) should be 12/16 of full transparency. The count of white cells for pixel H (702H) is 14 and the ratio for pixel H (702H) is 14/16. Accordingly, the transparency value for pixel H (702H) should be 14/16 of full transparency.

In one or more embodiments, the blending circuitry (436) is configured to modify the image data corresponding to the current line, based on the transparency values from the transparency calculation circuitry (434). In one or more embodiments, the blending circuitry (436) modifies the image data such that the pixels of the current line that overlap the intersection points are displayed with the calculated transparency values. The blending circuitry (434) may also be configured modify the image data corresponding to the current line by setting one or more regions of the image (e.g., regions outside rounded corners, a concave portion at the top) all black. These modifications, which are the result of simple calculations, enable the image to be displayed on a display panel of a unique shape while reducing jagged edges and the likelihood of color shifts. Moreover, these modification are achieved without the need for additional memory (e.g., additional RAM) and with less power consumption.

Figure 8:
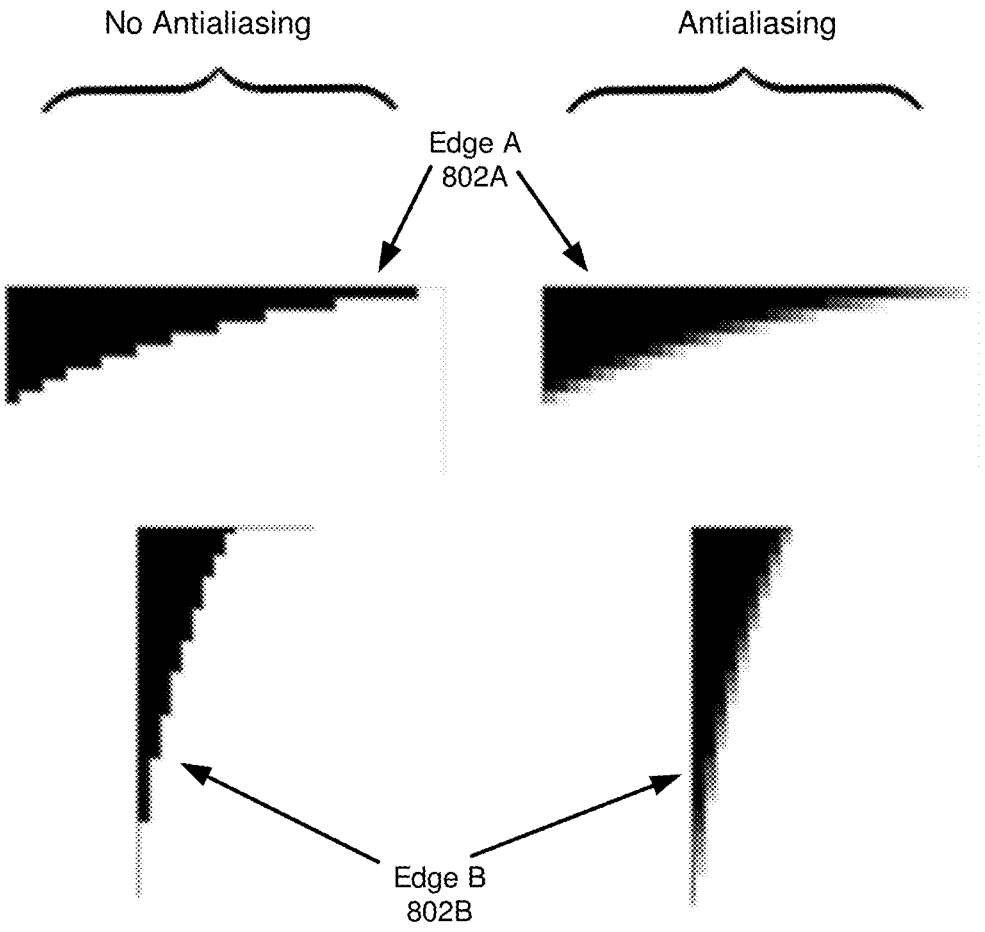
FIG. 8 shows an antialiasing example in accordance with one or more embodiments.

FIG. 8 shows multiple examples of antialiasing in accordance with one or more embodiments. FIG. 8 shows edge A (802A) with both no-antialiasing and antialiasing (e.g., as performed by transparency calculation circuitry (434) and blending circuitry (436)). FIG. 8 also shows edge B (802B) with both no-antialiasing and antialiasing. Those skilled in the art, having the benefit of this detailed description, will appreciate that the antialiasing results in a smoother curve (e.g., fewer jagged edges).

Referring back to FIG. 4, in one or more embodiments, the shape calculation circuitry (400) includes a buffer (432). The buffer (432) may be implemented with multiple flip-flops. The buffer (432) may be configured to latch onto the intersection points calculated by the intersection calculation circuitry (428). The buffer (432) may input the horizontal synchronization (Hsync), which signals the beginning of a new line. In one or more embodiments, activation of Hsync is the trigger for the buffer (432) to latch onto the intersection points.

Those skilled in the art, having the benefit of this detailed description, will appreciate that after the buffer (432) latches onto the intersection points, the intersection calculation circuitry (428) may start calculating intersection points for the next line, while the transparency calculation circuitry (434) may calculate transparency values for the current line based on the stored intersection points in the buffer (432).

Figure 9A:
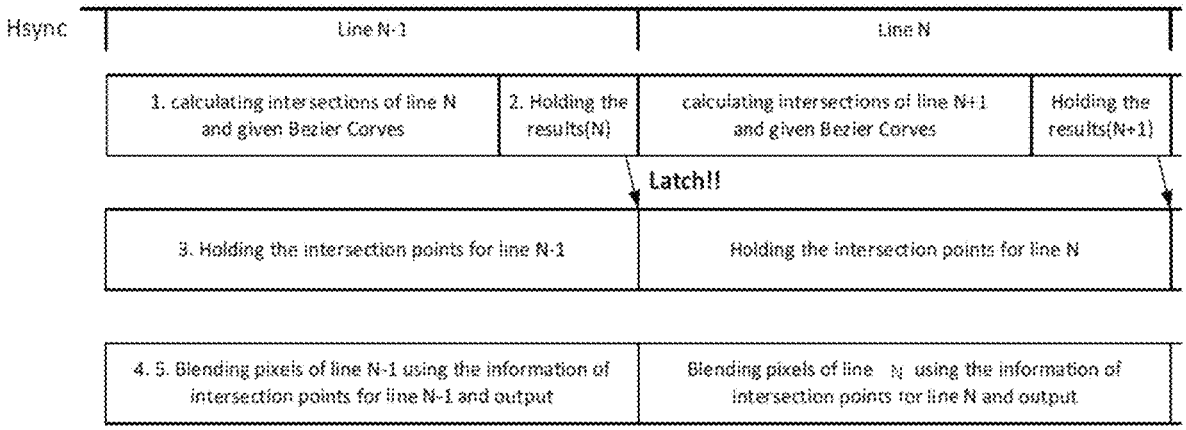
FIGS. 9A and 9B show time charts in accordance with one or more embodiments.
Figure 9B:
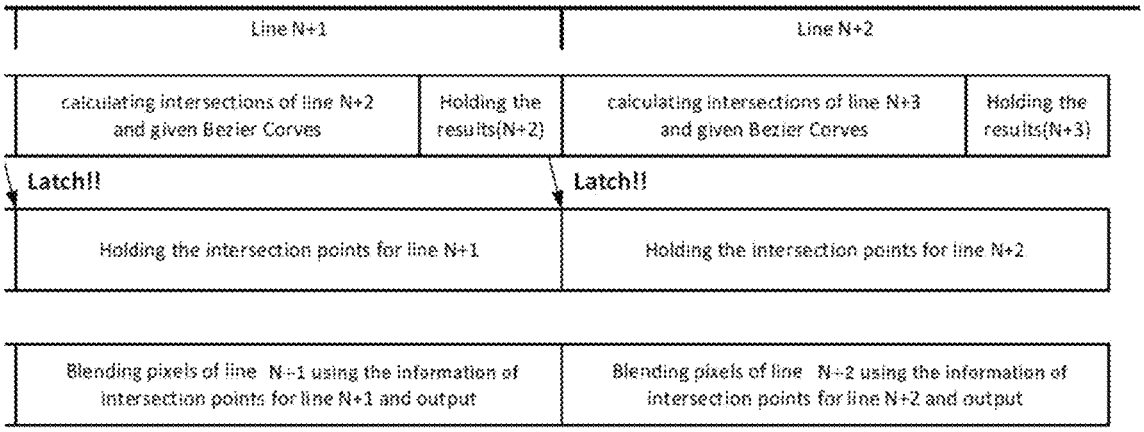

FIGS. 9A and 9B are time charts of the operation of the shape calculation circuitry (400). In one or more embodiments, the shape calculation circuitry (400) executes: 1. Calculate the intersections of the next line by the intersection calculation circuitry (428); 2. Latch the intersections for the next line by the buffer (432); 3. Hold the intersections for the current line by the buffering circuitry (432); and 4. Calculate the transparency values by the transparency calculation circuitry (434) and blend the input image data with the transparency values by the blending circuitry (436). As illustrated in FIG. 9A, when line N−1 is being processed, intersections between line N (N, N+0.25, N+0.50, and N+0.75) and the control points are obtained and latched until line N starts to be processed. When line N is being processed, the pixels of line N are blended with the transparency values obtained based on the intersections for line N, and the obtained image is output. At the same time, the intersections for line N+1 are obtained and latched until line N+1 starts to be processed. As illustrated in FIG. 9B, when line N+1 is being processed, the pixels of line N+1 are blended with the transparency values obtained based on the intersections for line N+1, and the obtained image is output. At the same time, the intersections for line N+2 are obtained and latched until line N+2 starts to be processed. The processing is repeated until the lines required for drawing the smooth edges have been processed.

In one or more embodiments, when the shape of the display panel includes small curves, the corner shapes might be corrupted because the repetition of the intersection calculations rounds down the decimal places. In one or more embodiments, to avoid such a corruption, the shape calculation circuitry (400) includes a multiplier (426) and a divider (430). The multiplier (426) may be disposed on the upstream side of the intersection calculation circuitry (428). The multiplier (426) may multiply the Y-coordinates of all the control points received from the judging circuitry (424) by a factor (β) and multiply the Y coordinate of the next line by the factor (β). The divider (430) may be disposed on the downstream side of the intersection calculation circuitry (428) and divide the calculation result of the intersection calculation circuitry (428) (i.e., the Y-coordinates of the intersection points) by the factor (β). In one or more embodiments, the factor β is previously determined such that the image is magnified and then reduced at an appropriate rate. This offsets the rounding down of decimal places performed by the intersection calculation circuitry (428).

Figure 10:
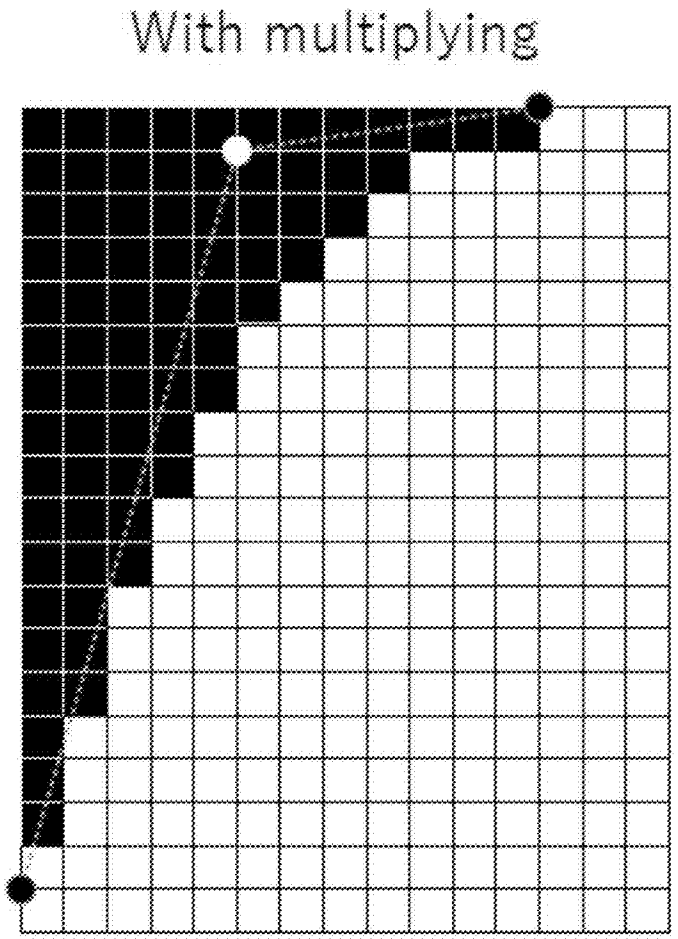
FIG. 10 shows an example in accordance with one or more embodiments.
Figure 10:
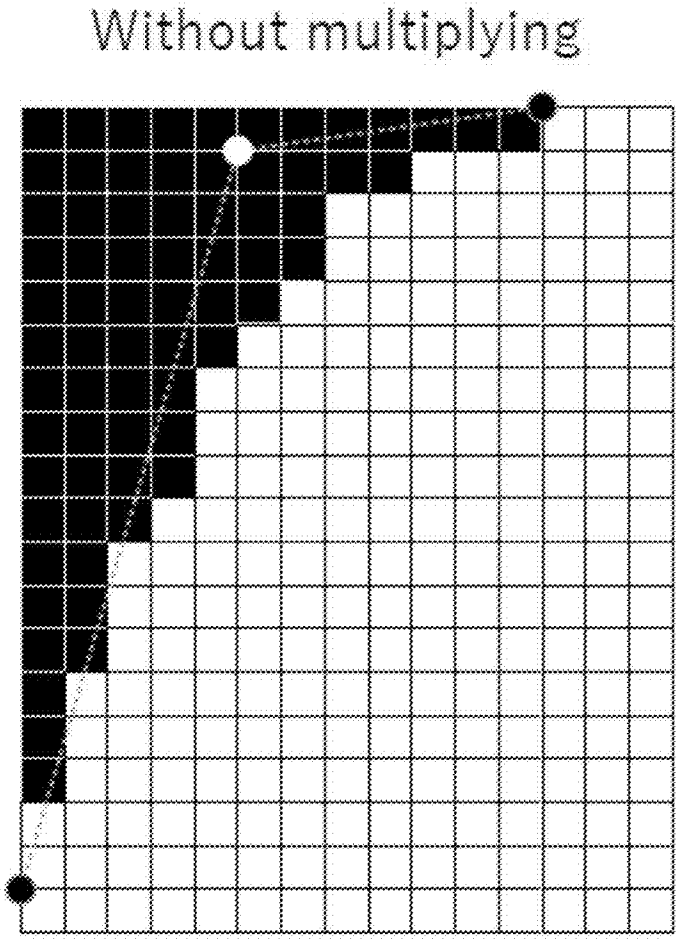

In one or more embodiments, FIG. 10 illustrates example results using the multiplier (426) and the divider (430). The image on the left is the corner image obtained without use of the multiplier (426) and the divider (430). As shown, the corner shape is jagged because the decimal places are rounded down in the calculation. The image on the right is the corner image obtained using the multiplier (426) and the divider (430). As shown, the corner is smoothly drawn because the decimal places are not rounded down.

Figure 11:
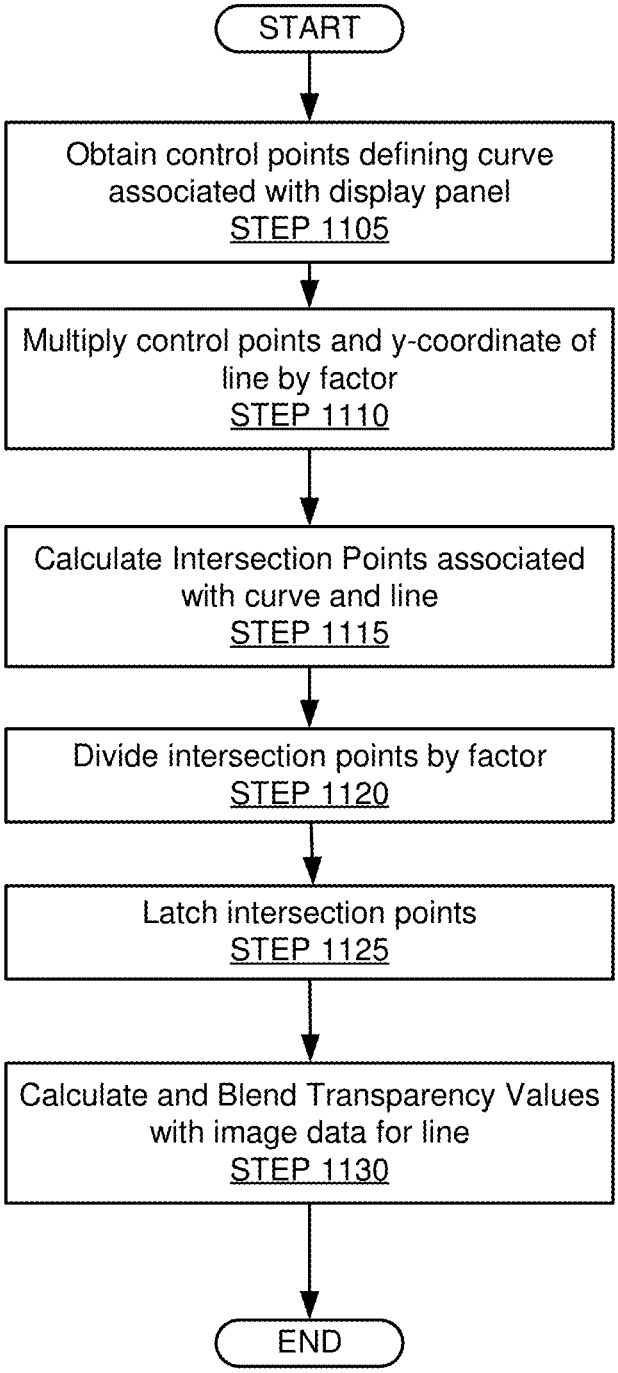
FIG. 11 shows a flowchart in accordance with one or more embodiments.

FIG. 11 shows a flowchart in accordance with one or more embodiments. The process depicted by the flowchart may be executed by one or more components of the shape calculation circuitry (400) (e.g., intersection calculation circuitry (428), buffer (432), transparency calculation circuitry (434), and blending circuitry (434)). In one or more embodiments, one or more of the steps shown in FIG. 11 may be omitted, repeated, and/or performed in a different order than the order shown in FIG. 11. Accordingly, the scope of the invention should not be considered limited to the specific arrangement of steps shown in FIG. 11.

Initially, control points defining a curve are obtained (STEP 1105). The curve may describe, at least in part, the unique shape of a display panel (e.g., a rounded corner of the panel display). In one or more embodiments, there are three control points for the curve: a starting point, an ending point, and a middle point. Although the starting point and the ending point are part of the curve, the curve might not pass through the middle point. Additionally or alternatively, any number of control points may be used. Moreover, the curve may correspond to a quadratic Bezier curve, a cubic Bezier curve, a quaternary Bezier curve, etc.

In STEP 1110, the control points and the y-coordinate of the next line are upscaled or multiplied by a factor β. STEP 1110 may be optional. In one or more embodiments, STEP 1110 is executed when the shape of the display panel has small curves that may be distorted due to rounding (e.g., by the intersection calculation circuitry (428)).

In STEP 1115, intersection points associated with the curve and the next line are calculated (e.g., by the intersection calculation circuitry (428)). The curve and the next line may intersect one or more times. As discussed above, the intersection point is a switching point between drawing the line in all black and drawing the line according to the original color(s) of the image. In one or more embodiments, the next line is divided into K segments (e.g., K=4), and an intersection point with the curve is calculated for each of the K segments. For example, in the case of line N and K=4, intersection points would be calculated for lines, N, N+0.25, N+0.5, and N+0.75.

In STEP 1120, the intersection points are downscaled or divided by the factor β. STEP 1120 may be optional and is only executed when STEP 1110 is executed.

In STEP 1125, the intersection points are latched. The intersection points may be latched by a buffer having flip-flops. The intersection points may be latched in response to an activation of the Hsync signal to signal a new line.

In STEP 1130, transparency values are calculated based on the intersection points. As discussed above, a line of a display panel is associated with a row (or column) of pixels. Some of the pixels include the intersection points. If a pixel overlaps with an intersection point, the pixel may be partitioned into a K×K grid of cells (due to the line width being partitioned into K segments). In one or more embodiments, the transparency value for the pixel is determined based on the position of the intersection point within the cells of the pixel. The transparency value may specify a ratio of full transparency.

Still referring to STEP 1130, the image data is modified based on the transparency values. In one or more embodiments, the image data is modified such that the portions of the image corresponding to the pixels of the line are displayed according to the calculated transparency values. This reduces the likelihood that the displayed image will have jagged edges. In one or more embodiments, the image data corresponding to the line is also modified such that one or more regions of the displayed image (e.g., a region of the image outside a rounded corner described by the curve) is set to black.

Following STEP 1130, the line may be drawn on the display panel. The process depict in FIG. 10 may be repeated for multiple lines of the display panel. Moreover, while some steps are being executed for the current line, other steps may be executed for the next line. For example, on the intersection points for the current line are latched in STEP 1125, STEP 1115 may be performed for the next line.

Thus, the embodiments and examples set forth herein were presented in order to best explain various embodiments and their particular application(s) and to thereby enable those skilled in the art to make and use the embodiments. However, those skilled in the art will recognize that the foregoing description and examples have been presented for the purposes of illustration and example only. The description as set forth is not intended to be exhaustive or to be limiting to the precise form disclosed. This also reduces the likelihood that the displayed image will have jagged edges.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

a memory configured to store a plurality of control points defining a curve associated with a display panel; and shape calculation circuitry configured to:

determine, based on the plurality of control points, a first intersection point of the curve and a width of a first line associated with the display panel; and modify image data of an image based on the first intersection point, wherein the shape calculation circuitry comprises transparency calculation circuitry configured to determine a first transparency value for a first pixel of the first line overlapping the first intersection point.

2. The display driver of claim 1, wherein the image comprises a first image region and a second image region defined based on the curve, and wherein the first image region is displayed on the display panel and the second image region is not displayed on the display panel.

3. The display driver of claim 1, wherein the first intersection point is determined by intersection circuitry.

4. The display driver of claim 3, wherein the shape calculation circuitry further comprises:

a buffer configured to latch the first intersection point for processing by the transparency calculation circuitry, wherein the intersection circuitry is configured to determine a second intersection point of the curve and a second line after the buffer latches the first intersection point.

5. The display driver of claim 3, wherein the shape calculation circuitry further comprises:

a multiplier configured to upscale a coordinate of the first line and coordinates of the plurality of control points before the intersection calculation circuitry determines the first intersection point; and a divider configured to downscale the first intersection point before the transparency calculation circuitry determines the first transparency value.

6. The display driver of claim 3, wherein the first intersection point is determined using midpoints.

7. The display driver of claim 3, wherein the shape calculation circuitry further comprises:

blending circuitry configured to modify a first portion of the image data associated with the first pixel based on the first transparency value before the first portion is displayed on the display panel.

8. The display driver of claim 7, further comprising:

gate line driving circuitry configured to drive gate lines of the display panel; and data line driving circuitry configured to drive data lines of the display panel based on an output of the blending circuitry.

9. The display driver of claim 7, wherein:

the intersection calculation circuitry is further configured to determine, based on the plurality of control points, a second intersection point of the curve and the width of the first line;

the transparency calculation circuitry is further configured to determine a second transparency value for a second pixel of the first line overlapping the second intersection point; and the blending circuitry is further configured to determine a second portion of the image data associated with the second pixel based on the second transparency value.

10. The display driver of claim 9, wherein the transparency calculation circuitry is further configured to determine the second transparency value based on:

partitioning the second pixel into a plurality of cells;

determining a count based on a location of the second intersection within the plurality cells; and calculating a ratio of the count to a cardinality of the plurality of cells.

11. The display driver of claim 10, wherein the width of the first line is divided into K segments, and wherein the second pixel comprises K rows and K columns of cells in response to dividing the width of the first line into K segments.

12. The display driver of claim 11, wherein the curve corresponds to a rounded corner of the display panel.

13. A method, comprising:

storing a plurality of control points defining a curve associated with a display panel;

determining, based on the plurality of control points, a first intersection point of the curve and a width of a line associated with the display panel;

modifying image data based on the first intersection point; and determining a first transparency value for a first pixel of the line overlapping the first intersection point.

14. The method of claim 13, further comprising:

modifying a first portion of the image data associated with the first pixel based on the first transparency value.

15. The method of claim 14, further comprising:

upscaling a coordinate of the line and coordinates of the plurality of control points before determining the first intersection point; and downscaling the first intersection point before determining the first transparency value.

16. The method of claim 14, further comprising:

determining, based on the plurality of control points, a second intersection point of the curve and the width of the line;

determining a second transparency value for a second pixel of the line overlapping the second intersection point; and modifying a second portion of the image data associated with the second pixel based on the second transparency value.

17. The method of claim 16, wherein determining the second transparency value comprises:

partitioning the second pixel into a plurality of cells;

determining a count based on a location of the second intersection within the plurality cells; and calculating a ratio of the count to a cardinality of the plurality of cells.

18. The method of claim 17, wherein the width of the line is divided into K segments, and wherein the second pixel comprises K rows and K columns of cells in response to dividing the width of the line into K segments.

19. A system, comprising:

a processing device comprising image data;

a display panel; and a display driver comprising:

a memory configured to store a plurality of control points defining a curve associated with the display panel; and shape calculation circuitry configured to:

determine, based on the plurality of control points, a first intersection point of the curve and a width of a line associated with the display panel; and modify the image data based on the first intersection point, wherein the shape calculation circuitry comprises transparency calculation circuitry configured to determine a first transparency value for a first pixel of the first line overlapping the first intersection point.

20. The system of claim 19, wherein the first intersection point is determined by intersection circuitry; and the shape calculation circuitry comprises blending circuitry configured to modify a first portion of the image data associated with the first pixel based on the first transparency value.

21. The system of claim 20, wherein:

the intersection calculation circuitry is further configured to determine, based on the plurality of control points, a second intersection point of the curve and the width of the line;

the transparency calculation circuitry is further configured to determine a second transparency value for a second pixel of the line overlapping the second intersection point; and the blending circuitry is further configured to determine a second portion of the image data associated with the second pixel based on the second transparency value.

22. The system of claim 21, wherein the transparency calculation circuitry is further configured to determine the second transparency value based on:

partitioning the second pixel into a plurality of cells;

determining a count based on a location of the second intersection within the plurality cells; and calculating a ratio of the count to a cardinality of the plurality of cells.

* * * * *